US011427778B2

(12) United States Patent
Seemeyer et al.

(10) Patent No.: US 11,427,778 B2
(45) **Date of Patent: *Aug. 30, 2022**

(54) LUBRICANT COMPOSITION

(71) Applicant: Klueber Lubrication Muenchen SE & Co. KG, Munich (DE)

(72) Inventors: Stefan Seemeyer, Wolfratshausen (DE); Stefan Grundei, Mering (DE); Carla Krutzsch, Taufkirchen (DE); Philipp Altmann, Kirchheim (DE)

(73) Assignee: KLUEBER LUBRICATION MUENCHEN SE & CO. KG, Munich (DE)

( * ) Notice: Subject to any disclaimer, the term of this patent is extended or adjusted under 35 U.S.C. 154(b) by 0 days.

This patent is subject to a terminal disclaimer.

(21) Appl. No.: 17/364,910

(22) Filed: Jul. 1, 2021

(65) Prior Publication Data

US 2021/0324287 A1 Oct. 21, 2021

Related U.S. Application Data

(63) Continuation of application No. 16/611,239, filed as application No. PCT/EP2018/060023 on Apr. 19, 2018, now Pat. No. 11,085,004.

(30) Foreign Application Priority Data

May 11, 2017 (DE) ..... 102017004541.0

(51) Int. Cl.

| | |
|---|---|
| ***C10M 107/34*** | (2006.01) |
| ***C10M 101/00*** | (2006.01) |
| ***C10M 125/26*** | (2006.01) |
| ***C10M 155/02*** | (2006.01) |
| ***C10M 169/00*** | (2006.01) |
| *C10N 20/06* | (2006.01) |
| *C10N 30/02* | (2006.01) |
| *C10N 40/02* | (2006.01) |
| *C10N 40/04* | (2006.01) |

(52) U.S. Cl.

CPC ..... *C10M 107/34* (2013.01); *C10M 101/00* (2013.01); *C10M 125/26* (2013.01); *C10M 155/02* (2013.01); *C10M 169/00* (2013.01); *C10M 2201/105* (2013.01); *C10M 2209/1023* (2013.01); *C10M 2209/1033* (2013.01); *C10M 2209/1075* (2013.01); *C10M 2229/041* (2013.01); *C10M 2229/043* (2013.01); *C10M 2229/046* (2013.01); *C10M 2229/047* (2013.01); *C10M 2229/048* (2013.01); *C10M 2229/051* (2013.01); *C10M 2229/052* (2013.01); *C10M 2229/053* (2013.01); *C10M 2229/054* (2013.01); *C10N 2020/06* (2013.01); *C10N 2030/02* (2013.01); *C10N 2040/02* (2013.01); *C10N 2040/04* (2013.01)

(58) Field of Classification Search

CPC ..... C10M 107/34; C10M 101/00; C10M 125/26; C10M 155/02; C10M 169/00; C10N 2020/06; C10N 2030/02; C10N 2040/02; C10N 2040/04

See application file for complete search history.

(56) References Cited

U.S. PATENT DOCUMENTS

| | | | | |
|---|---|---|---|---|
| 3,909,424 | A | 9/1975 | Clark | |
| 7,217,683 | B1 * | 5/2007 | Blanski | C10M 171/06 508/203 |
| 2003/0092585 | A1 | 5/2003 | Galic et al. | |
| 2011/0237473 | A1 | 9/2011 | Bartels et al. | |
| 2012/0256135 | A1 | 10/2012 | Green et al. | |
| 2014/0162914 | A1 | 6/2014 | Grundei et al. | |
| 2015/0299605 | A1 * | 10/2015 | Tomsheck | C10M 161/00 385/100 |

FOREIGN PATENT DOCUMENTS

| | | | |
|---|---|---|---|
| DE | 102007036856 | A1 | 2/2009 |
| DE | 102011103215 | A1 | 12/2012 |

(Continued)

OTHER PUBLICATIONS

Choi, et al. "Synthesis of POSS Derived Organic-Inorganic Hybrid Esters for Insulating Oil Applications," *Bull. Korean Chem. Soc.* 35, 9: 2769-2773 (Sep. 20, 2014), The Korean Chemical Society, Seoul, Korea. XP055485063.

Seydibeyoglu, et al. "Synergistic Improvements in the Impact Strength and % Elongation of Polyhydroxybutyrate-co-valerate and Copolymers with Functionalized Soybean Oils and POSS," *International Journal of Plastics Technology* 14, 1: 1-16 (Jun. 1, 2010), Springer India, New Dehli, India. XP055485692.

Anonymous, "PG1190—PEG POSS Cage Mixture," *hybrid: the Creators of POSS*: 1-4 (Mar. 24, 2015).

U.S. Appl. No. 16/611,239, filed Nov. 6, 2019.

*Primary Examiner* — Ellen M McAvoy

(74) *Attorney, Agent, or Firm* — Leydig, Voit & Mayer, Ltd.

(57) ABSTRACT

A lubricant composition for application onto a surface of drive elements includes: a base oil; and a silasesquioxane. In an embodiment, the silasesquioxane has the chemical formula $[RSiO3/2]_n$ with: n=6, 8, 10, 12; where R independently of one another=alkyl (C1-C20), cycloalkyl (C3-C20), alkenyl (C2-C20), cycloalkenyl (C5-C20), alkynyl (C2-C20), cycloalkynyl (C5-C20), aryl (C6-C18) or heteroaryl group, oxy, hydroxy, alkoxy (C4-C10), oxirane polymer (degree of polymerization with 4 to 20 repeat units), carboxy, silyl, alkylsilyl, alkoxysilyl, siloxy, alkylsiloxy, alkoxysiloxy, silylalkyl, alkoxysilylalkyl, alkylsilylalkyl, halogen, epoxy (C2-C20), ester, aryl ether, fluoroalkyl, blocked isocyanate, acrylate, methacrylate, mercapto, nitrile, amine, and/or phosphine group, each substituted or unsubstituted.

20 Claims, No Drawings

(56) References Cited

FOREIGN PATENT DOCUMENTS

| | | | |
|---|---|---|---|
| EP | 1642957 | A1 | 4/2006 |
| JP | S6020997 | A | 2/1985 |
| JP | 2006144827 | A | 6/2006 |

* cited by examiner

LUBRICANT COMPOSITION

CROSS-REFERENCE TO PRIOR APPLICATIONS

This application is a continuation of U.S. patent application Ser. No. 16/611,239, filed on Nov. 6, 2019, which is a U.S. National Phase application under 35 U.S.C. § 371 of International Application No. PCT/EP2018/060023, filed on Apr. 19, 2018, and claims benefit to German Patent Application No. DE 10 2017 004 541.0, filed on May 11, 2017. The International Application was published in German on Nov. 15, 2018 as WO/2018/206252 under PCT Article 21(2).

FIELD

The present invention relates to a lubricant composition for application onto the surface of drive elements, such as roller bearings, gears, slide bearings, and chains. The composition is suitable for preventing, reducing, or avoiding fatigue phenomena in the material of drive elements, such as gray staining, false brinelling, and white etching cracks. The present invention further relates to the use of the lubricant composition for treating the surfaces of drive elements and to the further use of such drive elements.

BACKGROUND

In the case of excessively high mechanical loads, two types of damage occur in drive elements:

1) Seizure and wear, in which the damage originates from the surface of the contact surfaces.

2) Fatigue damage that starts in the structure beneath the affected areas and ultimately ends in outbreaks, such as gray staining, false brinelling, and white etching cracks.

To reduce wear and seizure, there are a large number of additives and solid lubricants, which are well known and widely used.

To prevent fatigue damage, only a very few effective measures are known, one of which is to increase the lubricating film thickness.

Fatigue wear occurs due to local overloading of the material by periodic compression stress. The fatigue of the material is visible through gray patches (gray staining, surface fatigue, micropitting) or pits on the surface of the material. As a rule, initially 20 to 40 μm below the surface, there are fine cracks in the metal grid, which lead to material breaking. The small microscopically visible breaks on the tooth flank, referred to as micropitting or gray staining, can be seen macroscopically as matte gray areas. In the case of gear toothing, gray staining on tooth flanks can generally be observed practically in all speed ranges. In roller bearings too, very flat breaks occur in the area of the sliding contact as gray patches on the track. These relationships are described in detail in DE 10 2007 036 856 A1 and the literature cited therein.

White etching cracks (WEG) can lead to fatigue damage, which occurs much earlier than may be expected with a drive element under given stress parameters. In this case, cracks in the depth of the structure can be detected metallographically. The white discoloration is based on the fact that the seemingly white cracks are not subject to the etching required in the sample preparation. With further tribological loading, these cracks can lead to breakdowns in the material and to component failure. A number of factors such as slippage, harmful currents and diffused hydrogen are discussed as the cause.

Such damage is known to occur in particular in bearings of electric motors or generators of wind turbines and in the automotive sector (see also dissertation of H. Surborg, 2014, Otto von Guericke Universitat Magdeburg, Shaker Verlag Aachen 2014).

False brinelling is a form of damage that occurs in seemingly stationary bearings. By means of vibrations (for example in the case of machines but also during transport by means of motor vehicles, rail vehicles, or ships) or elastic deformations, micromovements are introduced into the contact surfaces, which can lead to damage even after a few load changes. This can lead to uneven running performance and immediate or premature component failure.

In principle, the damage mechanisms described above are among the most serious material impairments due to the resulting cracks.

To avoid this fatigue damage, the following measures are usually adopted in practice:

- Lowering the contact forces,
- Suitable selection of the lubricant,
- Sufficient supply of lubricant,
- Favorable positioning and design of the lubricating points,
- Avoidance of conditions without lubrication.

Furthermore, in order to improve viscosity properties in lubricants, different additives are used in order to avoid or at least minimize the aforementioned damage in roller bearings, gearwheels, gear units and the like.

In addition, various investigations have been made in order to avoid fatigue phenomena; among other things, attempts have been made to improve the lubricating action of lubricants by adding various additives. In particular, additives, which can reduce the friction between the components or which have an improved viscosity, have been investigated.

Thus, DE-OS 1 644 934 describes organophosphates as additives in lubricants that are added as anti-fatigue additives.

DE 10 2007 036 856 A1, already mentioned above, discloses the addition of polymers having ester groups, which are used as antifatigue additives in lubricants.

From US 2003/0092585 A1, thiazoles which can prevent damage to surfaces are known as additives.

EP 1,642,957 A1 relates to the use of MoS2 and molybdenum dithiocarbamate, which are used as additives in urea greases for propeller shafts.

The additives described above, known from the prior art, such as organophosphates and thiazoles, are not thermally stable as organic substances. Moreover, they can evaporate under the operating conditions or, as classical anti-wear additives, can react primarily with the metal surfaces, i.e. they react predominantly at the contacting roughness peaks since there is sufficient energy there for a chemical reaction with the metallic friction layer due to the flash temperatures occurring. They can therefore counteract fatigue damage, at most secondarily. Solid lubricants, such as molybdenum disulfide, on the other hand, have a tendency to deposit from oil formulations due to their density and can also have a corrosive effect. Since the solid particles are used with particle sizes in the micrometer range, there is a strong influence on flow behavior and an increase in viscosity, as well as a deviation from Newtonian flow behavior. This behavior deteriorates the availability of the additive in the lubricating gap. REM investigations on the surfaces of the metallic friction partners show that these structures have depressions with dimensions well below 1 μm. These depressions are inaccessible to solid lubricant particles in the micron range.

DE 102011103215A1 describes the use of a composition comprising surface-modified nanoparticles and a carrier material applied to the surfaces of drive elements for preventing or reducing fatigue damage. It is assumed that the mechanism of action of the nanoparticles is based on the fact that they accumulate on the surface of the drive elements and thereby smooth them. Contact surfaces are fixed by the smoothing and the surface pressure is reduced.

JP 2006144827 A mentions compositions with silica nanoparticles to suppress WEG damage.

A disadvantage of the compositions described in DE 102011103215 A1 and JP 2006144827A is that it is often difficult to achieve sufficient coverage of the OH groups on the surface of the nanoparticles via the available techniques. This can lead to stability problems during storage. In addition, the introduction of air can lead to foam formation. Finally, filtration problems may occur when filtering the lubricant.

SUMMARY

In an embodiment, the present invention provides a lubricant composition for application onto a surface of drive elements, comprising: a base oil; and a silasesquioxane.

DETAILED DESCRIPTION

In an embodiment, the present invention provides a lubricant composition which can be applied to the surfaces of drive elements so as to prevent, reduce, or avoid fatigue phenomena, such as gray staining, false brinelling, and white etching cracks, and which at least partially eliminates the aforementioned disadvantages occurring in the prior art.

The present invention relates to a lubricant composition for application to the surface of drive elements, wherein the lubricant composition contains a base oil and a silasesquioxane. The composition is suitable for preventing, reducing, or avoiding fatigue phenomena in the material of drive elements, such as gray staining, false brinelling, and white etching cracks. The positive influence of the lubricant composition is surprising since silasesquioxanes are significantly smaller than the nanoparticles described in documents DE 102011103215 A1 and JP 2006144827A, and therefore it could not be assumed that they can bring about a reduction in the fatigue phenomena analogously to these particles via surface smoothing.

In practical experiments, it has been found that the composition according to the invention can be homogeneously mixed with base oils of the most varied polarities, since, for example, the polarity of the composition can be easily adapted via the choice of the substituents of the silasesquioxane. The result of this is that sufficient saturation of the OH groups of the silasesquioxane can be ensured on account of its production process. Furthermore, it has been found that the use of silasesquioxane allows a high storage stability and that there is no impairment of the foaming behavior or filterability. In practical experiments, it has also been found that silasesquioxanes, which are liquid at room temperature (20° C.) and/or low melting points (preferably below 100° C., DIN EN ISO 11357-2 (output: 2014-07)), can be used favorably.

Silasesquioxanes (also called silasesquisiloxanes, sesquisiloxanes, or silasesquioxanes) are organosilicon compounds and form cage-like structures with Si—O—Si bonds and tetrahedral Si corners. The silasesquioxane can have, in molecular form 6 to 12, Si corners and/or be present as an oligomer and/or polymer. Preferred according to the invention are molecular silasesquioxanes, more preferably molecular silasesquioxanes with 6 to 12, more preferably 7 to 10, in particular with 7 or 8 Si corners. In a preferred embodiment, each Si center is bonded to three oxo groups, which in turn connect to other Si centers.

In a further preferred embodiment, the Si centers are bound only proportionately to three oxo groups connected to other Si centers, and preferably three Si centers are bonded to only two oxo groups connected to other Si centers. The third group here is preferably a substituent, more preferably a hydroxy substituent.

The fourth group on the Si is also preferably a substituent, whereby a surface-modified silasesquioxane can be obtained, which is preferred according to the invention. Suitable substituents are, for example, alkyl (C1-C20), cycloalkyl (C3-C20), alkenyl (C2-C20), cycloalkenyl (C5-C20), alkynyl (C2-C20), cycloalkynyl (C5-C20), aryl (C6-C18) or heteroaryl group, oxy, hydroxy, alkoxy (C4-C10), oxirane polymer (degree of polymerization with 4 to 20 repeat units), carboxy, silyl, alkylsilyl, alkoxysilyl, siloxy, alkylsiloxy, alkoxysiloxy, silylalkyl, alkoxysilylalkyl, alkylsilylalkyl, halogen, epoxy (C2-C20), ester, aryl ether, fluoroalkyl, blocked isocyanate, acrylate, methacrylate, mercapto, nitrile, amine, and/or phosphine group, each substituted or unsubstituted. The silasesquioxane may have the same substituents or mixtures of different substituents.

Preferred substituents are hydroxy, alkyl (C4-C10), aryl (C6-C12), in particular phenyl and tolyl, alkoxyl (C4-C10), alkenyl (C2-C10), oxirane polymer, in particular polyethylene glycol, polypropylene glycol, polybutylene glycol and/or copolymers thereof (degree of polymerization 4 to 20, in particular 10 to 15 repeat units) epoxy (C2-C10) and/or cycloalkyl (C5-C10) each substituted or unsubstituted.

Particularly preferred substituents are hydroxy, alkyl (C4-C10), phenyl, tolyl, alkoxyl (C4-C10) alkenyl (C2-C10) and/or oxirane polymer, in particular polyethylene glycol, polypropylene glycol and/or copolymers thereof (degree of polymerization 4 to 20, in particular 10 to 15 repeating units) each substituted or unsubstituted.

In a further embodiment of the invention, R may additionally comprise functional groups, in particular thio groups, phosphate groups, individually or in combination. The optionally present thio or phosphate groups can additionally undergo a reaction with the metal surface to be protected.

According to the invention, the silasesquioxane can also be mixtures of structurally different silasesquioxanes.

Silasesquioxanes can be synthesized, for example, by hydrolysis of organotrichlorosilanes (idealized: $8\ RSiCl_3 + 12\ H_2O \rightarrow [RSiO_{3/2}]_8 + 24\ HCl$). Depending on the substituent (R), the exterior of the cage can be further modified. When R=H, the Si—H group can be subjected to hydrosilylation or oxidation to the silanol. Bridged poly-silasesquioxanes are most readily prepared from clusters containing two or more trifunctional silyl groups attached to non-hydrolysable silicon carbon bonds. Vinyl-substituted silasesquioxanes can be linked by alkene metathesis.

In a preferred embodiment, the silasesquioxane has the chemical formula $[RSiO_{3/2}]n$ with: n=6, 8, 10, 12; preferably n=8, 10, 12 and especially 8, wherein R independently of one another=alkyl (C1-C20)-, cycloalkyl (C3-C20)-, alkenyl (C2-C20)-, cycloalkenyl (C5-C20)-, alkynyl (C2-C20), cycloalkynyl (C5-C20), aryl (C6-C18) or heteroaryl group, oxy, hydroxy, alkoxy (C4-C10), oxirane polymer (degree of polymerization with 4 to 20 repeating units)-, carboxy, silyl, alkylsilyl, alkoxysilyl, siloxy, alkylsiloxy, alkoxysiloxy, silylalkyl, alkoxysilylalkyl, alkylsilylalkyl, halogen, epoxy (C2-C20), ester, aryl ether, fluoroalkyl is blocked isocyanate, acrylate, methacrylate, mercapto, nitrile, amine, and/or phosphine group, each being substituted or unsubstituted.

The radicals R may be identical or different.

R is preferably, independently of one another, hydroxy, alkyl (C4-C10), aryl (C6-C12), in particular phenyl and tolyl, alkoxyl (C4-C10), alkenyl (C2-C10) oxirane polymer, in particular polyethylene glycol, polypropylene glycol, polybutylene glycol and/or copolymers thereof (degree of polymerization 4 to 20, in particular 10 to 15 repeat units) epoxy (C2-C10) and/or (C5-C10) each substituted or unsubstituted.

R is particularly preferably hydroxy, alkyl (C4-C10), phenyl, tolyl, alkoxyl (C4-C10), alkenyl (C2-C10) and/or oxirane polymer, in particular polyethylene glycol, polypropylene glycol and/or copolymers thereof (degree of polymerization 4 to 20, in particular 10 to 15 repeating units) each substituted or unsubstituted In a further embodiment of the invention, R may additionally comprise functional groups, in particular thio groups, phosphate groups, individually or in combination. The optionally present thio or phosphate groups can additionally undergo a reaction with the metal surface to be protected.

In a further preferred embodiment, the silasesquioxane has a structure derived from the chemical formula: $[RSiO_{3/2}]n$ in which one or more, preferably one, silicon unit RSi is replaced by other units. This silasesquioxane preferably has the formula $[RSiO_{3/2}]_n(R_2SiO)_3$ wherein the radicals R can be selected independently of one another from the above-described and n=2, 4, 6, 8, preferably n=2, 4, 6 and in particular is 4.

The use of bridged molecular siloxanes is likewise conceivable.

In a particularly preferred embodiment, the silasesquioxane is a silasesquioxane which has the formula (I):

(I)

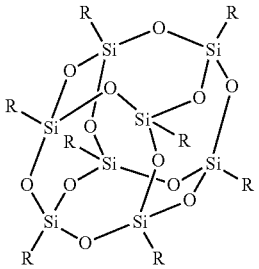

wherein: R independently of one another=oxirane polymer, preferably polyethylene glycol, polypropylene glycol, polybutylene glycol and/or copolymers thereof (degree of polymerization with 4 to 20, preferably 10 to 15 repeating units) and in particular $—CH_2CH_2(OCH_2CH_2)_mOCH_3$ and m=10 to 15, in particular is 13.3, wherein the silasesquioxane is optionally in the form of a mixture with other silasesquioxanes. Such a silasesquioxane is obtainable in the form of a mixture with other silasesquioxanes, for example under the trade name: PEG POSS® Cage Mixture from Hybrid Plastics.

In a further particularly preferred embodiment, the silasesquioxane is a silasesquioxane which has the formula (I) above, wherein: R independently of one another=alkyl (C4-C10), aryl (C6-C12), preferably isooctyl, isobutyl and/or phenyl, in particular isooctyl, wherein the silasesquioxane is optionally present in the form of a mixture with other silasesquioxanes. Such a silasesquioxane is in the form of a mixture with other silasesquioxanes, for example, obtainable under the trade name: Isooctyl POSS® Cage Mixture and Octaisobutyl POSS® from Hybrid Plastics.

In a further particularly preferred embodiment, the silasesquioxane is a silasesquioxane which has the formula (II):

(II)

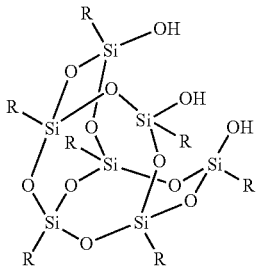

wherein R independently of=alkyl (C4-C10), preferably isooctyl. Such a silasesquioxane is obtainable, for example, under the trade name: TriSilanollsobutyl POSS® from Hybrid Plastics.

It has been found that the lubricant composition can also comprise mixtures of structurally different silasesquioxanes.

In a further preferred embodiment, the silasesquioxane is present on nanoparticulate carrier materials, preferably on oxidic nanoparticles, in particular on amorphous silicon dioxide nanoparticles. Such silasesquioxanes are obtainable, for example, under the tradename POSS® Nanosilica Dispersion from Hybrid Plastics. Advantageous here is the very good stabilization of the nanoparticles in various media and the combination of the two different particle types.

The silasesquioxane can be mixed directly with the base oil of the lubricant or in the form of a premix. In the case of introduction in the form of a premix, this advantageously contains a carrier material, preferably selected from the group consisting of mineral oils, synthetic hydrocarbons, including more preferably polyalphaolefins (PAO) and metallocene-catalyzed PAO (m-PAO), polyglycols, esters, perfluoropolyethers (PFPE), silicone oils, native oils and derivatives of native oils, aromatic-containing oils such as phenyl ethers, alkylated naphthalenes, and the mixtures of the aforementioned support materials. Polyglycols, esters, and synthetic hydrocarbons are particularly preferably used as carrier material.

The base oil of the lubricant composition is preferably selected from the group consisting of polyglycols, silicone oils, PFPE, mineral oils, esters, synthetic hydrocarbons, including particularly preferably PAO, m-PAO, aromatic-containing oils such as phenyl ethers, acylated diphenyl ethers, alkylated naphthalenes, phenyl ethers, native oils and derivatives of native oils, and the mixtures of base oils mentioned above. Particular preference is given to using as base oil polyglycols, esters and/or synthetic hydrocarbons, including particularly preferably polyalphaolefins (PAO) and metallocene-catalyzed PAO (m-PAO). Particularly preferred esters are selected from an ester of an aliphatic or aromatic di-, tri-, or tetracarboxylic acid (preferably C6- to C60-) with a or present in a mixture C7- to C22-alcohols, from an ester of trimethylolpropane, pentaerythritol, or dipentaerythritol with aliphatic C7- to C22-carboxylic acids, from C18-dimeric acid esters with C7- to C22-alcohols, from complex esters, as individual components or in any mixture.

The lubricant composition may additionally contain further customary additives, such as thickeners (metal soaps, metal complex soaps, bentonites, ureas, silicates, sulfonates, polyimides, etc.), solid lubricants (PTFE, metal oxides, graphite, boron nitride, molybdenum disulfide, etc.) and additives (phosphates, thiophosphates, aromatic amines, phenols, sulfates, etc.). Preferred thickeners are lithium soaps, lithium complex soaps, ureas, calcium complex soaps, calcium sulfonate thickeners, bentonites, aluminum complex soaps. Lithium soaps, lithium complex soaps, aluminum complex soaps, bentonites and ureas are particularly preferred thickeners.

Said additives can be soluble additives, in particular as anticorrosive agents, as agents for reducing friction, as agents for protection against metal influences and as UV stabilizers.

For gear applications, it has proven to be particularly advantageous if the lubricant composition has a viscosity of ISO VG 68-680, particularly preferably ISO VG 220-460. The base oils preferably used are polyglycols on the one hand and mixtures of synthetic hydrocarbons on the other hand, including particularly preferably mixtures of PAO with m-PAO, mixtures of esters, or compositions that have mixtures of synthetic hydrocarbons and esters as base oils. Medical white oils are likewise suitable.

For grease-lubricated applications in wind turbines, it has proven to be particularly favorable if the lubricant composition has an NLGI class according to DIN 51818 of 0 to 3, preferably 1 or 2. The base oil preferably has a viscosity in the range from 50 to 460 $mm^2$/sec. Preferred base oils are PAO, m-PAO, esters, and mixtures thereof. Preferred thickeners are lithium soaps, lithium complex soaps, and ureas.

For applications in the automotive sector, it has proven to be particularly favorable if the lubricant composition has an NLGI class according to DIN 51818 of 1 to 3. Preferred base oils are mineral oils, PAO, m-PAO, esters, and mixtures thereof. Preferred thickeners are lithium soaps, lithium complex soaps, calcium complex soaps, and ureas.

The base oil preferably has a viscosity in the range 30-300 $mm^2$/sec, preferably in the range 50-200 $mm^2$/sec.

The lubricant composition preferably contains the silasesquioxane in an amount of from 0.01 to 40% by weight, more preferably from 0.05 to 20% by weight, more preferably in an amount of 0.07 to 15% by weight, and in particular from 0.1 to 10% by weight, based on the total weight of the lubricant composition. In a further preferred embodiment, the lubricant composition contains the silasesquioxane in an amount of from 0.05 to 5% by weight.

The lubricant composition preferably contains the base oil in an amount of 99.99 to 50% by weight, more preferably 99 to 60% by weight and in particular in an amount of from 98 to 65% by weight, based on the total weight of the lubricant composition.

In a particularly preferred embodiment of the invention, the lubricant composition contains polyglycol as base oil in combination with a silasesquioxane of the formula $[RSiO_{3/2}]n$ with: n=6, 8, 10, 12, preferably n=8, 10, 12 and in particular 8, wherein R independently of one another=oxirane polymer, in particular polyethylene glycol, polypropylene glycol, and/or copolymers thereof (degree of polymerization 4 to 20, in particular 10 to 15 repeat units).

Also conceivable is the combination of polyglycol as the base oil with a silasesquioxane of formula $[RSiO_{3/2}]_n(R_2SiO)_3$, with n=2, 4, 6, 8, preferably n=2, 4, 6 and in particular 4, wherein R independently of one another=lower alkyl (C4-C10), preferably isobutyl octyl.

Particular preference is given to the combination of polyglycol as base oil with PEGPOSS® Cage Mixture.

In a further particularly preferred embodiment of the invention, the lubricant composition contains esters, hydrocarbons, alkylated diphenyl ethers as base oil in combination with a silasesquioxane which has the formula $[RSiO_{3/2}]n$ with n=6, 8, 10, 12, preferably n=8, 10, 12 and in particular 8, wherein: R=alkyl (C1-C20)-, or aryl (C6-C18)-, more preferably isooctyl, isobutyl, and/or phenyl.

In a further particularly preferred embodiment of the invention, the lubricant composition contains esters, hydrocarbons, alkylated diphenyl ethers as base oil in combination with a silasesquioxane comprising the above formula (I), wherein: R=isooctyl or isobutyl and/or phenyl. Particular preference is given to the combination of esters, hydrocarbons, alkylated diphenyl ethers as base oil with IsooctylPOSS® Cage Mixture, PhenylPOSS®, OctalsobutylPoss®.

The composition according to the invention generally comprises silasesquioxane in an amount of from 0.01 to 40% by weight, more preferably from 0.05 to 20% by weight, more preferably in an amount of 0.07 to 15% by weight, and in particular from 0.1 to 10% by weight; base oil in an amount of 99.99 to 50% by weight, more preferably in an amount of from 99 to 50% by weight, more preferably in an amount of from 99 to 60% by weight, in particular in an amount of from 98 to 65% by weight; thickeners in an amount of from 3 to 40% by weight, more preferably in an amount of from 5 to 40% by weight, and in particular in an amount of 7 to 25% by weight, and solid lubricants in an amount of 0% by weight to 30% by weight, more preferably in an amount of 0 to 20% by weight and additives in an amount of 0% by weight to 15% by weight, more preferably in an amount of 0 to 10% by weight and in particular in an amount of 2 to 10% by weight, each based on the total weight of the lubricant composition.

In a preferred embodiment of the invention, the lubricant composition contains:

- 5 to 80% by weight, preferably from 10 to 80% by weight, more preferably from 20 to 70% by weight, and in particular from 25 to 60% by weight polyalkylene glycol, preferably selected from the group consisting of randomly distributed polyoxyethylene and/or polyoxypropylene units and/or other polyoxyalkylene units, a block polymer of polyoxyethylene and/or polyoxypropylene units and/or other polyoxyalkylene units, as base oil and/or
- 5 to 80% by weight, preferably from 10 to 80% by weight, more preferably from 20 to 70% by weight, and in particular from 25 to 60% by weight carboxylic esters as base oil and/or
- 2 to 80% by weight, preferably from 10 to 80% by weight, more preferably from 20 to 70% by weight, and in particular from 25 to 60% by weight fatty alcohol ethoxylates as base oil,
- more than 10% by weight, preferably from 15 to 85% by weight, more preferably from 20 to 60% by weight and in particular from 25 to 50% by weight water,
- 0.01 to 40% by weight, more preferably from 0.05 to 20% by weight, more preferably from 0.07 to 15% by weight and/or from 0.05 to 5% by weight and/or from 0.1 to 10% by weight silasesquioxane, wherein the amounts are in each case based on the total weight of the lubricant composition.

Due to its water content, this lubricant composition can be considered a water-based lubricant composition.

In a preferred embodiment of the invention, the lubricant composition is in the form of a water-based gear oil formulation with which, when an FZG test according to DIN ISO 14635-3 is carried out, the power level 12 with total wear on wheel and pinion of <150 mg is passed and preferably no significant additional wear is generated with subsequent prolonged testing of 50 hours at power level 10.

Preferred base oils for the water-based lubricant composition are water-soluble polyalkylene glycols, water-soluble carboxylic esters, and/or water-soluble fatty alcohol ethoxylates. According to the invention, "water-soluble" means that, after mixing the base oils with water (stirring for 1 hour) in a concentration ratio of at least 5% by weight base oil in water at room temperature (25° C.) is a transparent liquid.

Particularly preferred carboxylic acid ester base oils for the water-based lubricant composition are selected from the group consisting of ethoxylated mono or dicarboxylic acids having a chain length of $C_4$-bis $C_{40}$- and ethoxylation degrees of 2-15.

Preferred fatty alcohol ethoxylates consist of fatty alcohols having chain lengths of $C_6$- to $C_{22}$- and a degree of ethoxylation of greater than 3.

Preferred additives for the water-based lubricant composition are selected from the group consisting of:

- 0.5 to 20% by weight, preferably from 0.5 to 10% by weight, foaming or non-foaming emulsifiers from the class of anionic, nonionic or cationic surfactants, preferably selected from the group consisting of aliphatic or aromatic ethoxylates, carboxylates, sulfonates, sulfates or ammonium salts,
- 0.5 to 50% by weight, preferably from 1 to 10% by weight, antifreeze, selected from the group consisting of alkylene glycol, glycerol or ionic liquids,
- 0.5 to 20% by weight, preferably from 5 to 20% by weight, corrosion additives selected from the group consisting of alkanolamines, phosphoric acid, and carboxylic acid derivatives,
- 0.001 to 2% by weight, preferably from 0.01 to 1% by weight, additives for preventing foaming, selected from the group consisting of polydimethylsiloxane and acrylate polymers,
- 0.05 to 10% by weight, preferably from 1 to 5% by weight of water-soluble protection and wear protection agents selected from the group consisting of sulfur- or phosphorus-containing compounds,
- 0.001 to 0.5% by weight, preferably from 0.05 to 0.4% by weight, biocides selected from the group consisting of substituted isothiazolinones and bronopol, and mixtures thereof.

In a further preferred embodiment of the invention, the water-based lubricant composition contains 0.5 to 40% by weight lubricant thickeners selected from the group consisting of metal soaps of mono and/or dicarboxylic acids, ureas, phyllosilicates, solid lubricants and aerosil.

In a preferred embodiment of the invention, the lubricant composition is in the form of a gear oil formulation with which C/8.3/60 is added when an FZG gray stain test is carried out. According to FVA information sheet 54/7 with injection lubrication, the profile deviation in the step run does not exceed 7.5 μm and/or during continuous run does not exceed 20 μm.

In a preferred embodiment of the invention, the lubricant composition is characterized in that, when a false Brinell test is carried out by means of SNR FEB 2 tester at room temperature, 8000 N load, pivot angle 3° and 24 Hz oscillation frequency, a running time of at least 50 his achieved and the wear of the drive element is preferably below 100 mg, in particular below 20 mg.

In a further preferred embodiment of the invention, the lubricant composition is characterized in that a mass loss of the drive element due to vibrations is reduced by at least 50%, preferably by at least 90%, and/or the time period until failure is at least doubled.

The present invention further relates to the use of the lubricant composition according to the invention for treating surfaces of drive elements, preferably roller bearings, gears, slide bearings and/or chains, in particular roller bearings and driven gears. The lubricant composition according to the invention for lubricating seals on rotating shafts is likewise suitable.

The use in roller bearings, which are used as wheel bearings, and/or gear units, which are subjected to vibration, is particularly advantageous. Furthermore, the use in main bearings, leaf bearings, adjusting bearings and generator bearings of wind turbines is particularly advantageous. Application in roller bearings used in electric motors of electrically driven vehicles is particularly advantageous. Application in roller bearings in clutches, in particular in hybrid vehicles, is particularly advantageous. Furthermore, the use in bearings in auxiliary units, in industrial plants as well as in automobiles, is particularly advantageous. Bearings in auxiliary units are characterized in that the auxiliary units are generally not operated continuously, but switched on only temporarily, and vibrations thus act on the stationary bearings. Auxiliary units in automobiles are also frequently driven by pulley. Furthermore, use in joints in automotive applications, such as constant velocity joints, azide joints, tripod joints, undercarriage joints and/or ball joints, in which material fatigue/breakdowns are likewise known as damage images, is particularly advantageous.

The above-mentioned drive elements are particularly susceptible to the damage mechanisms described at the outset, so that the use of silasesquioxanes with their advantageous influence on this is particularly efficient.

Moreover, it is particularly preferred to treat surfaces of drive elements in machines and conveying systems, which are used for the production of foodstuffs, in which direct contact of the lubricant composition with the food is possible and corresponding food-legal approval of the lubricant composition is required (USDA or NSF, Kosher, Halal).

The present invention further relates to the use of drive elements, preferably roller bearings, driven wheels, slide bearings and/or chains, the surfaces of which have been treated with the lubricant composition according to the invention, in installations and machines for producing and conveying foodstuffs, in wind turbines, in automobiles, in pulley bearings, in rail vehicles, in ships, in electric motors, generators, auxiliary units, joints.

Test Methods Used:

In SNR FEB 2 (False brinelling test stand of the roller bearing company SNR) the wear behavior of lubricant compositions in roller bearings is determined with a constant load in the case of small oscillating rolling and sliding movements. The shutdown criterion of the SNR is the wear distance. If the value rises above 30 mm in the case of a bearing, the run is ended automatically or else the predetermined running time is reached. The bearing type FAG 51206 is used as a test bearing. The resulting wear is determined not by the wear distance but by weighing the cleaned bearing rings before and after the test. The grooves of the bearing rings are completely filled with the lubricant composition to be tested, and excess grease is removed. Depending on the density, this results in an amount of lubricant composition of approx. 1 g per bearing ring.

Flender Foam Test GG-V 425 Rev.1

The test device consists of a closed gear casing with a visible disk. Two equalized gears (about 54 mm in diameter) are centrally mounted over perpendicular shafts that dip into the test oil so that a portion of the gears is not covered by oil. At a rotational speed of 1450 rpm, the gear pair is driven for 5 min. Air is mixed into the oil so to speak. The change/increase in volume can be documented via a scale introduced in the viewing window. Limit values of the standard are: after 1 min stopped, after the operation of the gear pair, <15% and after 5 min stopped <10% total. Foam volumes must not be exceeded.

Viscosity

Viscosity measurement (DIN 51562) using a Stabinger viscometer SVM 3000 (Anton Paar).

Foam Test ASTM D 892

In the method, air with a constant volume flow is foamed over an immersed sintered sphere at room temperature, then at 94° C. and then again at room temperature for 1 min. The following is measured: a) how much foam forms in ml and b) how long it takes for the foam to degrade after termination of the air introduction. Indication is (a, b). Limit value: (max. 75 ml/10 min) with all 3 temperature sequences, must not be exceeded, b is given in the form x:y min. This means that the foam has dissolved after x minutes and y seconds.

Gray Stain Test

C/8.3/60 according to FVA information sheet 54/7 with injection lubrication. The limit values of the standard are: The profile deviation must not exceed 7.5 μm during the step run and 20 μm during the continuous run. The test was partly also carried out differently at 90° C. and splash lubrication.

FZG Test Method A/2.8/50 for the Determination of Relative Creep Resistance and Wear Behavior of Gear Fluid Greases Implementation according to standard DIN ISO 14635-3 with splash lubrication. Limit values of the standard are:

Achieved power level=sum of damage (width of all grooves and feeders) on the active tooth flanks of the 16 pinion teeth is more than one tooth width or 20 mm, respectively.

Additionally evaluating wear on wheel and pinion.

In addition, after the end of the test, an extended test was carried out over a period of 50 h at power level 10 to determine the wear on wheel and pinion.

Filtration Test Stand:

A heatable oil reservoir (60° C.) is filled with approx. 10 l of oil, the oil is pumped using a regulable pump (Vogel Fluidtech GmbH/regulated by flow sensor) in the circuit (6 l/min) through a filter having a precisely defined pore separation (Mahle PI 2105 PS 3 μm/Mahle PI 3105 PS 10 μm) Before and after the filter, the pressure is measured by sensors. The system switches off when the pressure difference here exceeds 2.2 bar. The duration of the test is up to 840 h.

Example 1: Test for Improving the False Brinell Protection

A lithium soap grease of NLGI class 2 with polyglycol base oil with approx. 46 $mm^2$/sec viscosity at 40° C. and additive package (corrosion, oxidation stability, load Carrying® capacity, wear) was mixed with 5.85% PEGPOSS® Cage Mixture and homogenized with a speed mixer (Hauschild, Type DAO 700.1 FVZ) (example grease 1). PEGPOSS® Cage Mixture has a viscosity of approx. 80 mm7 sec at 40° C. To compensate for the dilution effect, a comparison grease 1 was prepared in which the grease in the same way was diluted 5.85% of a polyglycol based on EO:PO about 1:1 with comparable viscosity and homogenized. Both greases were exposed to a swivel angle of 3°, a vibration frequency of 24 Herz at 20° C. with the SNR FEB 2 test stand at an 8000 N load. Example grease 1 reaches the intended test duration of 50 h with a low mass loss of the bearings. On the other hand, the comparative grease 1 reaches the maximum permissible wear after approx. 19 h; the run must be stopped.

| | Example grease 1, PG grease, lithium soap, PG g base oil + diluted with 5.85% PEGPOSS ® Cage Mixture | Comparison grease 1, PG grease, Lithium soap, PG base oil + diluted with 5.85% PG Base oil |
|---|---|---|
| Wear, bearing 1 (mg) | 21 | 95 |
| Wear, bearing 2 (mg) | 0 | 216 |
| Test duration | 50 h | 19 h, 28 min (aborted) |

Example 2: Effect of Silasesquioxane to Suppress Gray Staining in an Ester Oil for Gear Units

| | Reference oil 2: Ester-based gray oil, ISO VG 100 additive package (corrosion, foam, oxidation stability, load carrying capacity, wear) | Reference oil 2 + 1.3% Isooctyl POSS ® Cage Mixture |
|---|---|---|
| Kinematic viscosity 40° C. [$mm^2$/sec] | 98 | 99.3 |
| ASTM foam test | | |
| RT | 0 ml/0 min | 0 ml/0:0 min |
| 94° C. | 0 ml/0 min | 0 ml/0:0 min |
| RT | 0 ml/0 min | 10 ml/0:03 min |
| FZG gray stain test, C/8, 3/60 | | |
| Step test, change in weight (mg) according to power level 10 | 24 | 16 |
| Step test, gray staining area (%) according to power level 10/400 h | 30 | 20 |
| Step test, profile shape deviation (μm) according to power level | 8.8 (fail) | 7.3 (pass) |
| Continuous test, change in weight (mg) according to power level | fail* | 35 |
| Continuous test, gray staining area (%) | fail* | 23 |
| Continuous test, profile shape deviation | fail* | 10.8 (pass) |
| *Failure after 240 h power level 10 by exceeding damage limit, profile shape deviation >20 μm | | |

The results show that in the ester-based gear oil no changes in kinematic viscosity and foaming behavior result upon addition of IsooctylPOSS®. The formation of gray patches, on the other hand, is strongly suppressed; the addition of IsooctylPOSS® Cage Mixture means that the test run can be carried out over the entire test time and the profile shape deviation remains well below the limit values.

Example 3: Effect of Silasesquioxane for Reducing Foam Formation and Micropitting in Polyglycol-Based Gear Oil

| | Reference oil 3: Polyglycol gear oil, Additive package (corrosion, oxidation stability, load carrying capacity, wear, foam) ISO VG 100 | Reference Oil 3 + 5.8% PEGPOSS ® age Mixture |
|---|---|---|
| Viscosity 40° C. [$mm^2$/sec] | 101 | 102 |
| ASTM foam test | | |
| RT | 10 ml/0:15 min | 0 ml/0:0 min |
| 94° C. | 20 ml/0:15 min | 10 ml/0:0 min |
| RT | 20 ml/0:25 min | 10 ml/0.03 min |
| Flender foam test | | |
| Foam after 1 min standstill (%) | 20 | 0 |
| Foam after 5 min standstill (%) | 19 | 4 |
| FZG gray stain test, C/8, 3/90° C. splash lubrication | | |
| Step test, change in weight (mg) according to power level 10 | 17 | 1 |
| Step test, gray staining area (%) according to power level 10 | 10 | 0 |
| Step test, profile form deviation (μm) according to power level 10 | 5 | 4.6 |
| Continuous test, change in weight (mg) according to power level 10/400 h | 11 | 8 |
| Continuous test, gray staining area (%) according to power level 10/400 h | 20 | 0 |
| Continuous test, profile shape deviation (μm) according to power level 10/400 h | 9.6 | 7 |

By adding PEGPOSS® Cage Mixture, there is no significant change in viscosity or ASTM foam test; however, there is a significant improvement in the Flender foam test and the occurrence of gray patches is almost completely suppressed.

Example 4: Filterability of Silasesquioxane-Containing Oils in Comparison to Oils Containing $SiO_2$ Nanoparticles

| | Reference oil 4: Gear oil PAO/ester ISO VG 46 Additive package (corrosion, oxidation stability, load carrying capacity, wear, foam) | Reference Oil 4 + 1.3% IsooctylPOSS ® | Reference oil 4 + 0.5% $SiO_2$ nano-particles, primary particles 10 nm, with surface occupied phenyl and Trimethyl-silyl groups |
|---|---|---|---|
| Viscosity 40° C. [$mm^2$/sec] | 46.2 | 47 | 47.6 |
| Flender foam test, prior to filtration testing | | | |
| Foam after 1 min standstill (%) | 2 | 2 | 2 |
| Foam after 5 min standstill (%) | 0 | 3 | 2 |
| Filtration 3 μm filter | | | |
| Pressure build-up/test duration | <2.2 bar/840 h | <2.2 bar/840 h | >2.2 bar/0 h |
| Filterability | pass | pass | fail |
| Flender foam test, after filtration testing 3 μm | | | |
| Foam after 1 min standstill (%) | 4 | 5 | not determined |
| Foam after 5 min standstill (%) | 5 | 5 | not determined |
| Filtration test 10 μm filter | | | |
| Pressure build-up/test duration | not determined | <2.2 bar/760 h | >2.2 bar/0 h |
| Filterability | not determined | pass | fail |

Reference oil 4 can be filtered easily at 3 μm. The addition of IsooctylPOSS® Cage Mixture has no effect on viscosity and good filtration and foam behavior.

By using $SiO_2$ nanoparticles, which can likewise be used to reduce micropitting, high pressures are, on the other hand, necessary for effective filtration. The proportion of inorganic $SiO_x$ is approximately the same for the two oils with the silicon-containing aggregates.

Even in the case of a coarser filter with 10 μm, it is not possible to filter $SiO_2$-containing oil at low pressures; a pressure of more than 2.2 bar builds up immediately, and the test is terminated. On the other hand, the oil containing IsooctylPOSS® Cage Mixture can be filtered without problem.

Example 5: Effect of Silasesquioxane for Reducing Wear in Water-Based Gear Oil

| | Reference oil 5: water-based gear oil based on polyglycol (approx. 39% by weight) additive package (approx. 21% by weight corrosion, load-canying capacity/wear, foam, biocide), water (approx. 40% by weight) | Reference Oil 5 + 1% by weight PEGPOSS ® Cage Mixture |
|---|---|---|
| Viscosity 40° C. | ISO VG 460 | ISO VG 460 |
| | FZG DIN ISO 14635-3-A/2, | |
| 8/50 splash lubrication | | |
| Power level reached | 12 | 12 |
| Total wear according to Power level 11 | 188 mg | 96 mg |
| Total wear according to Power level 12 | 231 mg | 145 mg |
| Additional wear according to Power level 10/50 h | 63 mg | 7 mg |

By adding PEGPOSS® Cage Mixture, there is no significant change in the viscosity, on the other hand there is a significant improvement in the wear behavior in gear applications, especially at moderate load (power level 10).

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. A lubricant composition for application onto the surface of drive elements, the composition comprising:

a base oil comprising polyglycols, synthetic hydrocarbons, mixtures of synthetic hydrocarbons and esters, aromatic oils, or any mixture thereof, and a silasesquioxane having chemical formula $[RSiO3/2]_n$, wherein n is 6, 8, 10, 12; and wherein each R independently is alkyl (C1-C20), cycloalkyl (C3-C20), alkenyl (C2-C20), cycloalkenyl (C5-C20), alkynyl (C2-C20), cycloalkynyl (C5-C20), aryl (C6-C18) or heteroaryl group, oxy, hydroxy, or alkoxy (C4-C10), oxirane polymer.

2. The lubricant composition of claim 1, wherein each R independently is hydroxy, alkyl (C4-C10), aryl (C6-C12), alkoxyl (C4-C10), alkenyl (C2-C10), oxirane polymer or cycloalkyl (C5-C10), wherein the oxirane polymer has a degree of polymerization of 4 to 20 repeat units.

3. The lubricant composition of claim 2, wherein the oxirane polymer comprises polyethylene glycol, polypropylene glycol, polybutylene glycol, or copolymers thereof.

4. The lubricant composition of claim 1, wherein each R independently is hydroxy, alkyl (C4-C10), phenyl, tolyl, alkoxyl (C4-C10), alkenyl (C2-C10), or oxirane polymer, wherein the oxirane polymer has a degree of polymerization of 10 to 15 repeat units.

5. The lubricant composition of claim 4, wherein the oxirane polymer comprises polyethylene glycol, polypropylene glycol, polybutylene glycol, or copolymers thereof.

6. The lubricant composition of claim 1, wherein the silasesquioxane comprises a silasesquioxane according to formula (I):

(I)

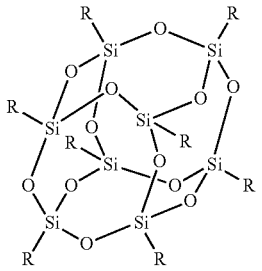

wherein each R independently is oxirane polymer, isoctyl, isobutyl, or phenyl, wherein the oxirane polymer comprises polyethylene glycol, polypropylene glycol, polybutylene glycol, or copolymers thereof, and the oxirane polymer has a degree of polymerization of 4 to 20.

7. The lubricant composition of claim 6, wherein the oxirane has formula $—CH_2CH_2(OCH_2CH_2)_mOCH_3$, wherein m=10 to 15.

8. The lubricant composition of claim 6, wherein the silasesquioxane is in the form of a mixture with other silasesquioxanes.

9. The lubricant composition of claim 1, wherein the silasesquioxane is present on nanoparticulate support materials.

10. The lubricant composition of claim 9, wherein the nanoparticulate support materials comprise oxidic nanoparticles.

11. The lubricant composition of claim 1, wherein the base oil comprises polyalphaolefins (PAO), metallocene-catalyzed PAO (m-PAO), phenyl ethers, acylated diphenyl ethers, alkylated diphenyl ethers, alkylated naphthalenes, or mixtures thereof.

12. The lubricant composition of claim 1, wherein:

the base oil comprises 5 to 80% by weight polyalkylene glycol, 2 to 80% by weight fatty alcohol ethoxylates, or a mixture thereof, optionally further in combination with 5 to 80% by weight carboxylic esters, the composition further comprises more than 10% by weight of water, and the silasesquioxane is present in an amount of 0.01 to 40% by weight, wherein each amount is based on the total weight of the lubricant composition.

13. The lubricant composition of claim 12, wherein the polyalkylene glycol, carboxylic acid ester, and/or fatty alcohol ethoxylate are water soluble.

14. The lubricant composition of claim 1, wherein the silasesquioxane is present in an amount of from 0.01 to 40% by weight, based on the total weight of the lubricant composition.

15. The lubricant composition of claim 1, wherein the base oil comprises hydrocarbons and alkylated diphenyl ethers, and each R independently is isoctyl, isobutyl, or phenyl.

16. The lubricant composition of claim 1, wherein:

the silasesquioxane is present in an amount of from 0.01 to 40% by weight;

the base oil is present in an amount of 99.99 to 50% by weight; and the lubricant composition further comprises:

thickeners in an amount of from 3 to 40% by weight;

solid lubricants in an amount of 0% by weight to 30% by weight; and additive in an amount of 0% by weight to 15% by weight;

wherein each amount is based on the total weight of the lubricant composition.

17. The lubricant composition of claim 1, wherein the lubricant composition is in the form of a gear oil formulation and, when an FZG gray stain test C/8.3/60 is carried out according to FVA information sheet 54/7 with injection lubrication, a profile shape deviation in a step run does not exceed 7.5 μm and/or during continuous run does not exceed 20 μm.

18. The lubricant composition of claim 1, when applied to a drive element and a false Brinell test is carried out on the drive element using SNR FEB 2 tester at room temperature, 8000 N load, swivel angle 3°, and 24 Hz oscillation frequency, a running time of at least 50 h is achieved and wear of the drive element is less than 100 mg.

19. A method comprising applying the lubricant composition of claim 1 to surfaces of drive elements, wherein the drive elements are present in installations and machines for producing and conveying foodstuffs, in wind turbines, in automobiles, in pulley bearings, in rail vehicles, in ships, in electric motors, in generators, in auxiliary units, or in joints.

20. A method comprising operating an apparatus comprising drive elements, wherein the drive elements comprise surfaces comprising the lubricant composition of claim 1, wherein the drive elements are present in installations or machines for producing and conveying foodstuffs, in wind turbines, in automobiles, in pulley bearings, in rail vehicles, in ships, in electric motors, in generators, in auxiliary units, or in joints.

* * * * *